US008132625B2

(12) United States Patent
Anderson

(10) Patent No.: US 8,132,625 B2
(45) Date of Patent: Mar. 13, 2012

(54) DUAL ACTION JET BUSHING

(75) Inventor: Neil A. Anderson, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 287 days.

(21) Appl. No.: 12/436,881

(22) Filed: May 7, 2009

(65) Prior Publication Data

US 2010/0282472 A1 Nov. 11, 2010

(51) Int. Cl.
*E21B 31/08* (2006.01)

(52) U.S. Cl. ..... 166/318; 166/99; 166/105.1

(58) Field of Classification Search ..... 166/51, 166/99, 105.1, 154, 317, 318, 322
See application file for complete search history.

(56) References Cited

U.S. PATENT DOCUMENTS

| | | | | |
|---|---|---|---|---|
| 2,327,051 | A | | 8/1943 | Lyons et al. |
| 2,915,127 | A | * | 12/1959 | O'Farrel ..... 166/99 |
| 3,066,735 | A | | 12/1962 | Zingg |
| 3,382,925 | A | * | 5/1968 | Jennings ..... 166/99 |
| 4,031,957 | A | | 6/1977 | Sanford |
| 4,088,191 | A | | 5/1978 | Hutchison |
| 4,276,931 | A | * | 7/1981 | Murray ..... 166/99 |
| 4,296,822 | A | * | 10/1981 | Ormsby ..... 175/249 |
| 4,499,951 | A | | 2/1985 | Vann |
| 4,541,486 | A | | 9/1985 | Wetzel et al. |
| 4,709,760 | A | | 12/1987 | Crist et al. |
| 4,796,704 | A | | 1/1989 | Forrest et al. |
| 5,533,571 | A | | 7/1996 | Surjaatmadua et al. |
| 6,065,451 | A | | 5/2000 | Lebrun |
| 6,102,060 | A | | 8/2000 | Howlett et al. |
| 6,173,795 | B1 | | 1/2001 | McGarian et al. |
| 6,176,311 | B1 | | 1/2001 | Ryan |
| 6,189,617 | B1 | | 2/2001 | Sorhus et al. |
| 6,276,452 | B1 | | 8/2001 | Davis et al. |
| 6,341,653 | B1 | | 1/2002 | Firmaniuk et al. |
| 6,401,822 | B1 | | 6/2002 | Baugh |
| 7,383,881 | B2 | | 6/2008 | Telfer |
| 7,431,091 | B2 | | 10/2008 | Themig et al. |
| 7,434,625 | B2 | | 10/2008 | Adams |
| 7,789,154 | B2 | | 9/2010 | Davis |

FOREIGN PATENT DOCUMENTS

WO 2006123109 A1 11/2006

* cited by examiner

*Primary Examiner* — David Bagnell
*Assistant Examiner* — Richard Alker
(74) *Attorney, Agent, or Firm* — Steve Rosenblatt

(57) ABSTRACT

An eductor sub is used as a portion of a downhole debris removal apparatus. It features an eductor outlet port that is selectively closed for run in to allow flow pumped through a tubing string to all go to the lower end of the debris removal tool to fluidize the debris and help prevent the tool from getting stuck on the way to the desired depth. When the desired depth is reached a ball lands on a seat that is connected to a sleeve that is displaced to move the sleeve away from the eductor outlet so that future flow coming down the casing string will create a reduced pressure within the tool to draw some of the exiting flow after the eductor exit in a downhole direction along an annular space to the debris removal tool entrance for debris removal.

18 Claims, 2 Drawing Sheets

DUAL ACTION JET BUSHING

FIELD OF THE INVENTION

The field of the invention is eductors for downhole use and more particularly eductors used with downhole debris removal devices that can be configured for circulation and reconfigured downhole for eductor service.

BACKGROUND OF THE INVENTION

Debris removal tools operate on several principles. Some are run in the hole and simply pulled out and capture what falls into a basket on the way out. Other designs involve a peripheral seal and tool movement with the seal extended to route fluid flow through the tool when it is moved downhole so that a screen can block the debris and retain it in the tool body while the fluid continues through. Some tools use circulation or reverse circulation through a string running from the surface that supports the tool. In some of these designs the flow with debris is urged into the debris catcher while the main fluid stream without the debris continues to the surface.

Another type of debris removal tool uses an eductor to draw fluid into the tool that is part of a bottom hole assembly. The eductor exhaust goes into the annular space and recirculates to the surface. Normally about 3 times the volume circulates from the eductor exhaust of the tool to the surface than the volume induced to flow into the tool by the negative pressure created by the eductor. One such tool is the VACS tool in Product Family H 13125 sold by Baker Oil Tools. FIG. 1 is a schematic of this tool. It has an inlet 10 at a lower end that leads to an inlet tube 12. A deflector cap 14 keeps debris from falling back into tube 12 if circulation represented by arrow 16 is stopped. Flow exits from under cap 14 as indicated by arrow 18 and then flows through screen 20 as indicated by arrow 22. Debris falls outside the screen 20 and into annular space 24 where it is collected to be removed when the tool is brought to the surface. Arrow 26 is the debris free fluid being sucked into the inlet 28 of the eductor or venturi device 30. Motive fluid for the venturi 30 is provided by pumped fluid down the tubing string 32 as indicated by arrow 34. It enters the motive fluid inlet 36 and creates a reduced pressure zone at inlet 28. The two streams commingle and exit out the eductor outlet 38 and then out through some aligned housing ports 40 as indicated by arrow 42. Most of the flow goes uphole as indicated by arrow 44 and the rest goes downhole to the tool bottom as indicated by arrows 46 and then 16 due to the negative pressure created by the eductor 30 at its inlet 28.

FIG. 3 shows the debris removal tool T supported by a tubular string 100. A bushing 102 is fixedly supported at shoulder 104 and has a peripheral seal 106. Inside of passage 108 is a sleeve 110 with an exterior seal 112 against the passage 108. Passage 114 leads to an eductor 116 whose outlet port 118 is aligned with housing exit port 120. Sleeve 122 is pinned at pin or pins 124 so that it covers the housing port 120. Split ring 126 has built in radially outward bias, and in the FIG. 3 position is illustrated in a radially compressed state. Eventually it will be brought into alignment with groove 128 to lock the position of sleeve 122 in the FIG. 4 position. A support ring 130 has a plurality of holes 132 along with a shoulder 134 in the central opening to accept sleeve 110 at a shoulder 136 that surrounds it. A ball 140 can be pumped down to land on the top of sleeve 110 to block the passage 142. With pressure applied to the ball 140, the shear pins 124 break and the sleeve 110 takes with it sleeve 122 to open the passages 102 to all the eductors 116 that are assembled in the device. Ports 120 are now open and flow can go in an uphole direction as shown by arrow 143 or in a downhole direction as shown by arrow 144. The flow in the downhole direction 144 is induced by the reduced pressure created by the eductors 116 in the passage around sleeve 110 as illustrated by arrow 146.

FIG. 2 shows the eductor 30 in more detail and illustrates the problem solved by the present invention. During run in, ball 48 is not in the position shown in FIG. 2 landed on seat 50 in sleeve 51 that does not move. Flow 34 coming down the string 32 can go two ways. It can go into the eductor inlet 36 which is always exposed and flow uphole as indicated by arrow 44 or without ball 48 in position on seat 50 it can flow down passage 54 to the bottom of the tool and exit at the lower end 10 and then come up the surrounding annular space and join with the flow from the eductor exiting from the opening 40.

The problem in the past is that during running into a well with debris to be removed it is helpful for advancing the tool that as much circulation fluid be directed at the bottom outet of the tool 10 as is possible for fluidizing the debris and preventing the tool from getting stuck. As presently configured not all the flow that is pumped down the string 32 gets down to the outlet 10 at the bottom of the tool. Some of the pumped fluid down the string 32 goes through the eductor 30 and turns uphole after exiting outlets 40 and does nothing for the need to fluidize debris ahead of the tool being run downhole. It would be advantageous to be able to direct all the fluid being pumped through the string 32 when advancing the tool out through its lower end 10 and the present invention allows for doing just that and still allowing the tool to work in the way that it normally operates.

The tool of the present invention allows all the flow heading down the string 32 to get out to the bottom 10 of the tool by keeping the housing outlet 40 closed for run in. After the lower position is reached where debris removal is set to start a ball is dropped to shift a sleeve to open the outlet 40 to allow the tool to operate in the manner described above. These and other aspects of the present invention will be more readily apparent to those skilled in the art from a review of the detailed description and the associated drawings while recognizing that the full scope of the invention is to be determined from the literal and equivalent scope of the claims.

SUMMARY OF THE INVENTION

An eductor sub is used as a portion of a downhole debris removal apparatus. It features an eductor outlet port that is selectively closed for run in to allow flow pumped through a tubing string to all go to the lower end of the debris removal tool to fluidize the debris and help prevent the tool from getting stuck on the way to the desired depth. When the desired depth is reached a ball lands on a seat that is connected to a sleeve that is displaced to move the sleeve away from the eductor outlet so that future flow coming down the casing string will create a reduced pressure within the tool to draw some of the exiting flow after the eductor exit in a downhole direction along an annular space to the debris removal tool entrance for debris removal.

DETAILED DESCRIPTION OF THE PREFERRED EMBODIMENT

Figure 3:
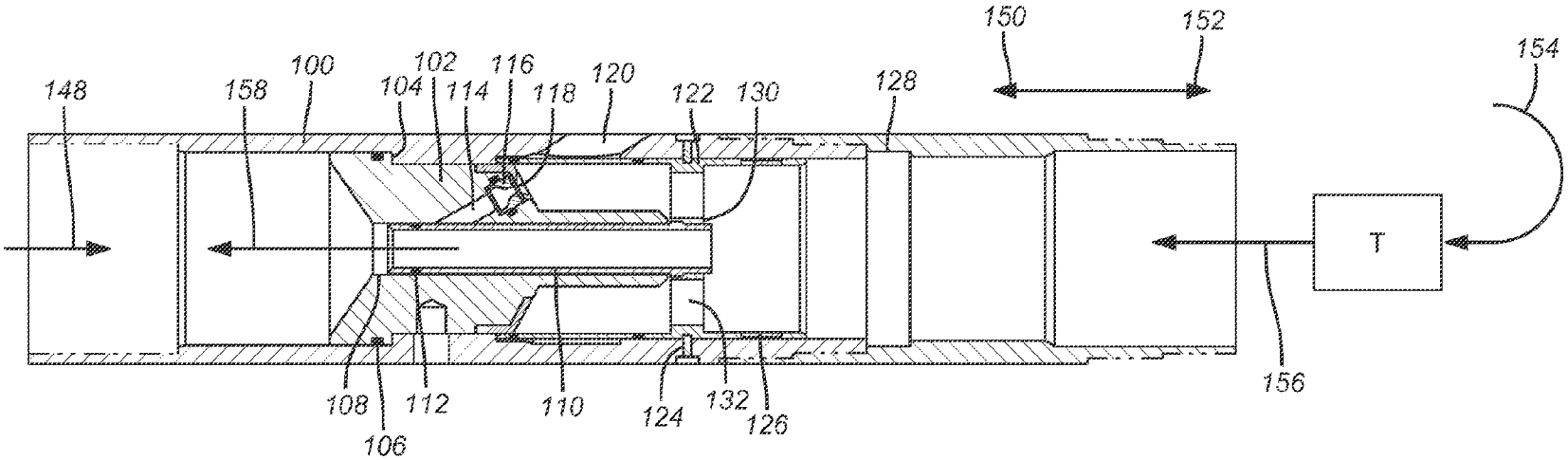
FIG. 3 is the tool of the present invention shown in the run in position to allow circulation of all fluid pumped down the string to circulate to the tool bottom.

FIG. 3 shows the debris removal tool T supported by a tubular string 100. A bushing 102 is fixedly supported at shoulder 104 and has a peripheral seal 106. Inside of passage 108 is a sleeve 110 with an exterior seal 112 against the passage 108. Passage 114 leads to an eductor 116 whose outlet port 118 is aligned with housing exit port 120. Sleeve 122 is pinned at pin or pins 124 so that it covers the housing port 120. Split ring 126 is compressed against a built in radially outward bias in the FIG. 3 position. Eventually it will be brought into alignment with groove 128 to lock the position of sleeve 122 in the FIG. 4 position. A support ring 130 has a plurality of holes 132 along with a shoulder 134 in the central opening to accept sleeve 110 at a shoulder 136 that surrounds it. A ball 140 can be pumped down to land on the top of sleeve 110 to block the passage 142. With pressure applied to the ball 140, the shear pins 124 break and the sleeve 110 takes with it sleeve 122 to open the passages 102 to all the eductors 116 that are assembled in the device. Ports 120 are now open and flow can go in an uphole direction as shown by arrow 142 or in a downhole direction as shown by arrow 144. The flow in the downhole direction 144 is induced by the reduced pressure created by the eductors 116 in the passage around sleeve 110 as illustrated by arrow 146.

In the FIG. 3 position for run in, the flow is through the string 100 as illustrated by arrow 148 and then down the length of the tool T and back up to the surface in the surrounding annulus as indicated by arrowhead 150. In that manner all the flow pumped down the string 100 has to go through the debris removal tool T and out through its lower end as all the lateral exits are closed by the sleeve 110 and the sleeve 122. This is the run in configuration that not only allows circulation to advance the tool T into the well but it also allows debris removal by changing the circulation flow described earlier to a reverse circulation flow as indicated by arrowhead 152 and arrows 154, 156 and 158. Depending on the nature of the well fluid, this reverse circulation may alone be enough of a fluid movement to entrain debris and bring it into the lower end of the tool T. However, if the well fluid is changed to less viscous fluids like brine or treated sea water, the jet action will likely need to be activated to enhance debris entrainment and hence removal.

Figure 1:
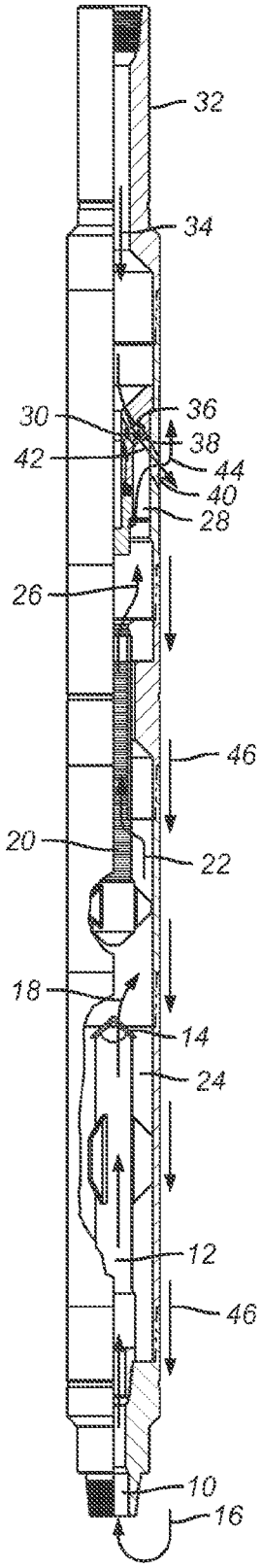
(PRIOR ART) FIG. 1
FIG. 1 is an elevation view in section of the known VACS tool sold by Baker Oil Tools.
Figure 2:
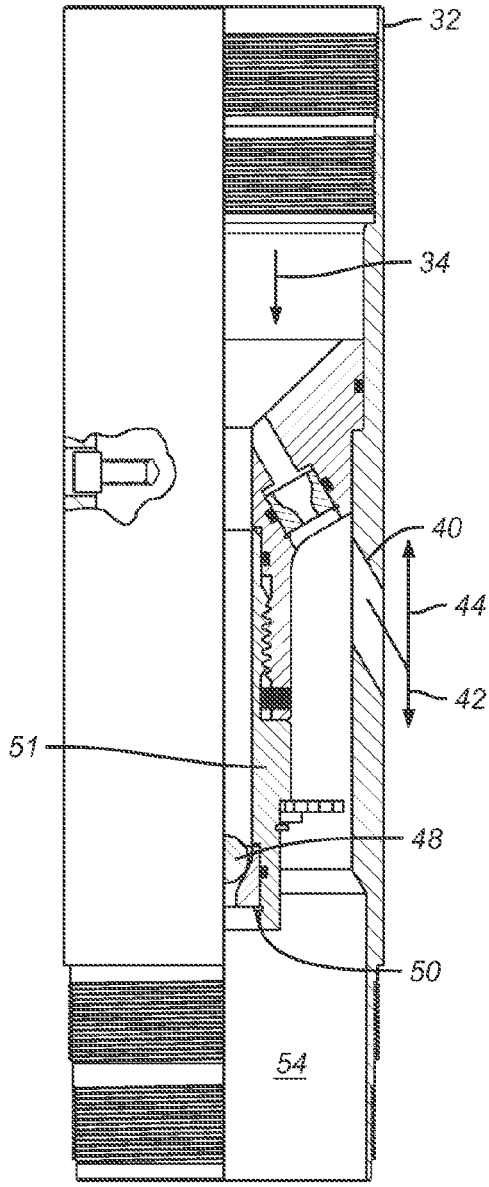
(PRIOR ART) FIG. 2
FIG. 2 is a detailed view of the eductor assembly of the tool shown in FIG. 1.

To convert to jet action operation, the ball 140 is landed at 138 on sleeve 110 and pressure is built up. The shear pins 124 break as the sleeve 110 moves down and sleeve 122 moves in tandem with it. Split ring 126 expands radially outwardly into groove 128 to lock the shifted position in FIG. 4 of the sleeve 122. Now the passage 146 is obstructed with ball 140 and passages 114 and 120 are wide open. At this point fluid pumped into the string 100 results in the operation described above with regard to FIGS. 1 and 2.

Figure 4:
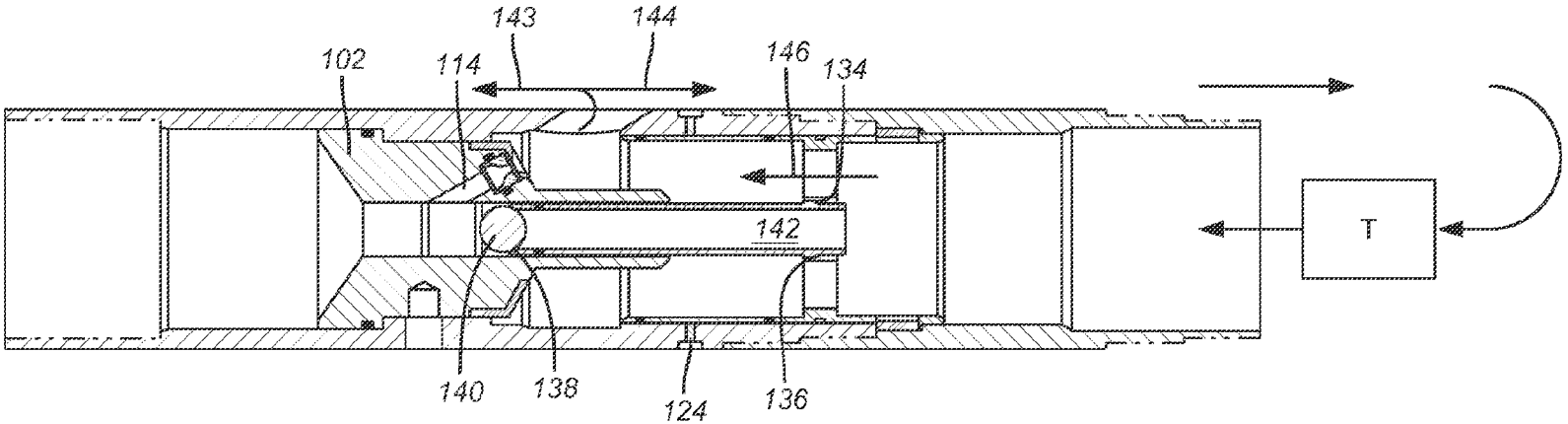
FIG. 4 is the tool of FIG. 3 is the operating position for debris removal.

While the device illustrated in FIGS. 3 and 4 is described in context of a debris cleanup tool, those skilled in the art will know that it has broader applications to any tool that uses recirculation during normal operations and it is desired to maximize the flow in circulation mode for running in or to allow the option of operation with simple recirculation without the jet assist from eductors 116. It simply allows all the fluid to pass through the tool for run in and one mode of operation while allowing a shift in operating mode to use the enhanced circulation abilities with the eductors. As a result, the tool can be run in faster with less concern about getting stuck since the debris can be better fluidized with higher flow rates ahead of the advancing tool T.

The above description is illustrative of the preferred embodiment and many modifications may be made by those skilled in the art without departing from the invention whose scope is to be determined from the literal and equivalent scope of the claims below:

I claim:

1. A recirculation sub for placement above a bottom hole assembly, comprising:

a housing having a first passage extending therethrough from an uphole to a downhole end and extending in the direction of a longitudinal axis thereof and at least one lateral port in a wall that defines said housing;

an internal assembly configured in a first position to pass all fluid entering said passage uphole end through said passage and in a second position to enable a recirculation flow between said port and the bottom hole assembly using fluid delivered at said passage uphole end;

said internal assembly further comprising a movable member obstructing at least one lateral passage in said first position and opening said lateral passage in said second position, said second position of said movable member opening said lateral port that had been closed in said first position of said movable member;

said lateral passage is substantially aligned with said lateral port.

2. The recirculation sub of claim 1, wherein:

said first passage is selectively blocked to through flow from said uphole to said downhole end.

3. The recirculation sub of claim 2, wherein:

said movable member comprises a flow path therethrough to close said first passage when said flow path is obstructed by an object.

4. The recirculation sub of claim 3, wherein:

said movable member responsive to applied pressure on said object when said object blocks said flow path.

5. The recirculation sub of claim 1, wherein:

said lateral passage ends with a gap to said lateral port, said gap in communication with said passage.

6. The recirculation sub of claim 5, wherein:

said lateral passage further comprises a device for reducing fluid pressure in said gap.

7. The recirculation sub of claim 6, wherein:

said device comprises a fluid nozzle.

8. The recirculation sub of claim 7, wherein:

said at least one lateral passage comprises a plurality of passages each with a fluid nozzle and each with a gap to a substantially aligned lateral port.

9. A recirculation sub for placement above a bottom hole assembly, comprising:

a housing having a first passage extending therethrough from an uphole to a downhole end and extending in the direction of a longitudinal axis thereof and at least one lateral port in a wall that defines said housing;

an internal assembly configured in a first position to pass all fluid entering said passage uphole end through said passage and in a second position to enable a recirculation flow between said port and the bottom hole assembly using fluid delivered at said passage uphole end;

said lateral port is selectively blocked.

10. A recirculation sub for placement above a bottom hole assembly, comprising:

a housing having a first passage extending therethrough from an uphole to a downhole end and extending in the direction of a longitudinal axis thereof and at least one lateral port in a wall that defines said housing;

an internal assembly configured in a first position to pass all fluid entering said passage uphole end through said passage and in a second position to enable a recirculation flow between said port and the bottom hole assembly using fluid delivered at said passage uphole end;

said passage is selectively blocked to through flow from said uphole to said downhole end;

said internal assembly comprises a movable member with a flow path therethrough to close said passage when said flow path is obstructed by an object;

said movable member obstructing at least one lateral passage in said first position and opening said lateral passage in said second position;

said lateral passage is substantially aligned with said lateral port;

said lateral passage ends with a gap to said lateral port, said gap in communication with said passage;

said lateral passage further comprises a device for reducing fluid pressure in said gap;

said device comprises a fluid nozzle;

said movable member moves in tandem with a sleeve that selectively blocks said lateral port.

11. The recirculation sub of claim 10, wherein:

movement of said movable member to said second position opens said lateral passage and opens said lateral port by moving said sleeve.

12. The recirculation sub of claim 11, wherein:

said sleeve locks to said housing after being moved away from said lateral port.

13. The recirculation sub of claim 12, wherein:

said sleeve is releasably secured to said housing by a breakable member.

14. A recirculation sub for placement above a bottom hole assembly, comprising:

a housing having a first passage extending therethrough from an uphole to a downhole end and extending in the direction of a longitudinal axis thereof and at least one lateral port in a wall that defines said housing;

an internal assembly configured in a first position to pass all fluid entering said passage uphole end through said passage and in a second position to enable a recirculation flow between said port and the bottom hole assembly using fluid delivered at said passage uphole end;

said passage is selectively blocked to through flow from said uphole to said downhole end;

said internal assembly comprises a movable member with a flow path therethrough to close said passage when said flow path is obstructed by an object;

said movable member moves in tandem with a sleeve that selectively blocks said lateral port.

15. The recirculation sub of claim 14, wherein:

movement of said movable member from a first to a second position opens a lateral passage aligned with said lateral port and opens said lateral port by moving said sleeve.

16. A recirculation sub for placement above a bottom hole assembly, comprising:

a housing having a first passage extending therethrough from an uphole to a downhole end and extending in the direction of a longitudinal axis thereof and at least one lateral port in a wall that defines said housing;

an internal assembly configured in a first position to pass all fluid entering said passage uphole end through said passage and in a second position to enable a recirculation flow between said port and the bottom hole assembly using fluid delivered at said passage uphole end;

said lateral port is selectively blocked;

said internal assembly comprises a movable member with a flow path therethrough to close said passage when said flow path is obstructed by an object.

17. A recirculation sub for placement above a bottom hole assembly, comprising:

a housing having a first passage extending therethrough from an uphole to a downhole end and extending in the direction of a longitudinal axis thereof and at least one lateral port in a wall that defines said housing;

an internal assembly configured in a first position to pass all fluid entering said passage uphole end through said passage and in a second position to enable a recirculation flow between said port and the bottom hole assembly using fluid delivered at said passage uphole end;

said lateral port is selectively blocked;

said internal assembly comprises a movable member with a flow path therethrough to close said passage when said flow path is obstructed by an object;

said movable member obstructing at least one lateral passage in said first position and opening said lateral passage in said second position.

18. The recirculation sub of claim 17, wherein:

said lateral passage substantially aligned and terminating before said lateral port to define a gap in communication with said passage;

said movable member moving a sleeve to uncover said lateral port when moving to its said second position;

said lateral passage further comprises a flow responsive device to reduce pressure in said gap for inducing recirculation flow between said lateral port and the bottom hole assembly.

* * * * *